US006715824B2

(12) United States Patent
Zheng

(10) Patent No.: US 6,715,824 B2
(45) Date of Patent: Apr. 6, 2004

(54) APPARATUS TO SECURE A FURNITURE FRAMEWORK

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/208,108

(22) Filed: Jul. 29, 2002

(65) Prior Publication Data

US 2003/0020304 A1 Jan. 30, 2003

Related U.S. Application Data

(63) Continuation-in-part of application No. 09/585,250, filed on May 30, 2000.

(51) Int. Cl.[7] ..... A47C 4/00
(52) U.S. Cl. ..... 297/16.2; 248/166; 297/45
(58) Field of Search ..... 297/16.1, 16.2, 297/35, 45; 248/166, 440, 439

(56) References Cited

U.S. PATENT DOCUMENTS

| | | | | | |
|---|---|---|---|---|---|
| 244,216 | A | * | 7/1881 | Fenby | 297/45 |
| 598,698 | A | * | 2/1898 | Crooks | 248/166 |
| 1,381,136 | A | * | 6/1921 | Ribeiro | |
| 3,138,401 | A | * | 6/1964 | McLean | 297/45 |
| 3,331,629 | A | * | 7/1967 | Munson et al. | 297/45 |
| 3,485,528 | A | * | 12/1969 | Kramer | 297/45 |
| 4,437,700 | A | * | 3/1984 | Elaschuk | 297/45 |
| 5,984,406 | A | | 11/1999 | Lee | 297/16.2 |

* cited by examiner

*Primary Examiner*—Peter R. Brown
*Assistant Examiner*—Stephen Vu
(74) *Attorney, Agent, or Firm*—Rutan & Tucker

(57) ABSTRACT

An apparatus for supporting a furniture application with a framework having a cross frame structure, the cross frame structure including a horizontal support clement that is pivotally attached to one cross support element and is removably latched onto another cross support element.

9 Claims, 6 Drawing Sheets

FIG. 3
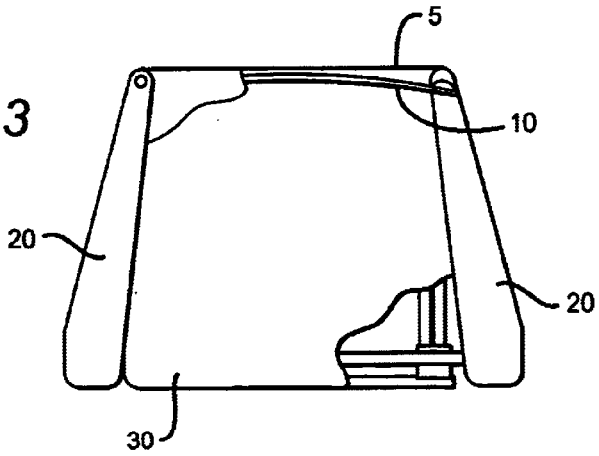
FIG. 2
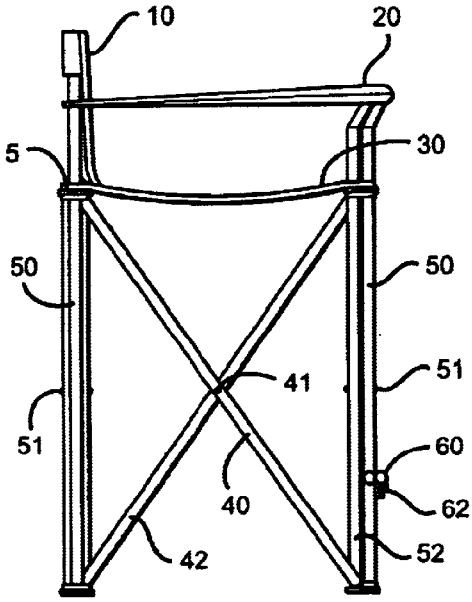
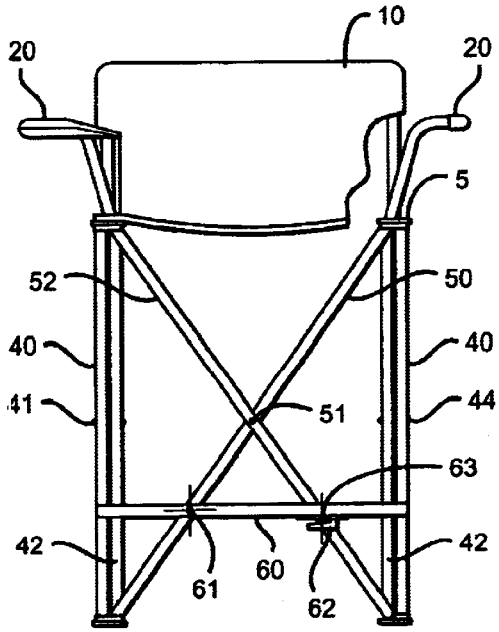
FIG. 1

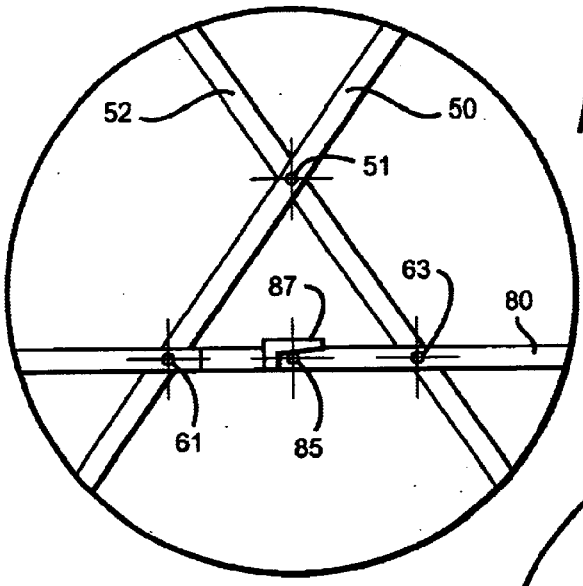
FIG. 11
FIG. 12
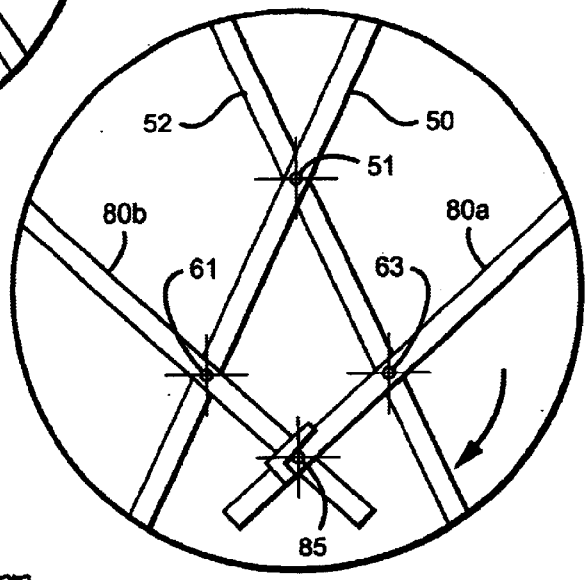
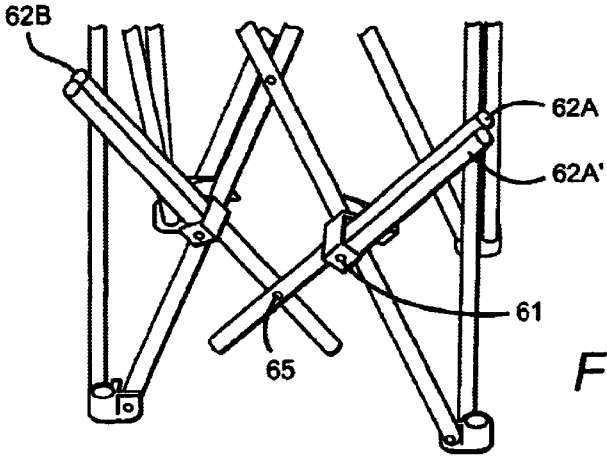
FIG. 15

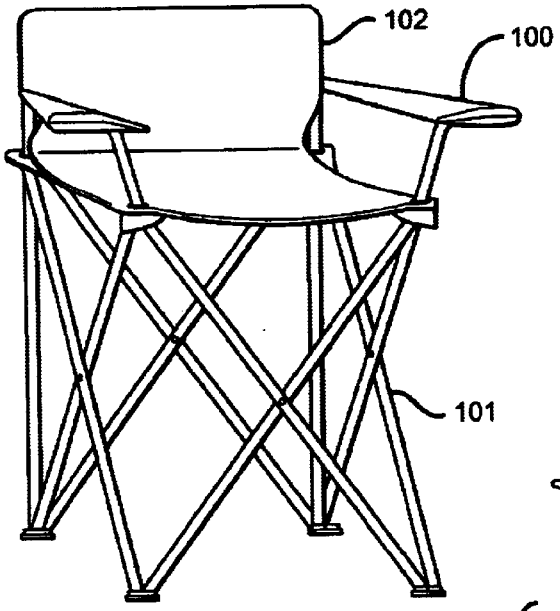
FIG. 13
FIG. 14
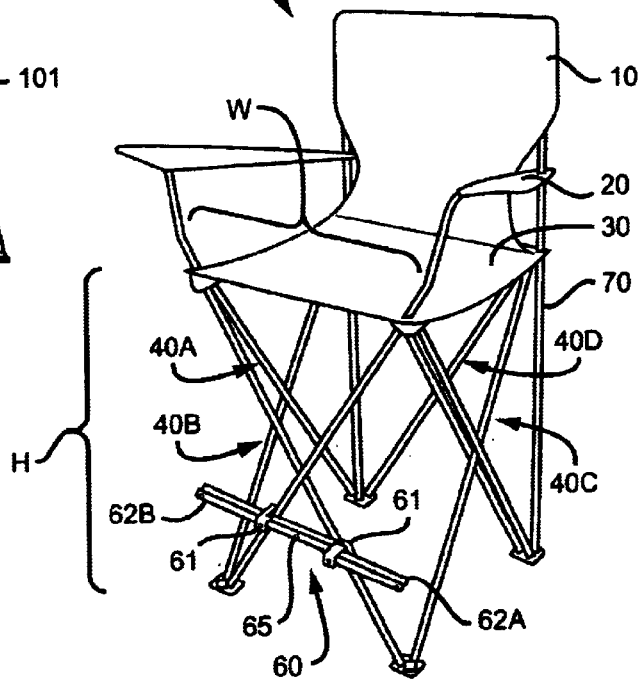
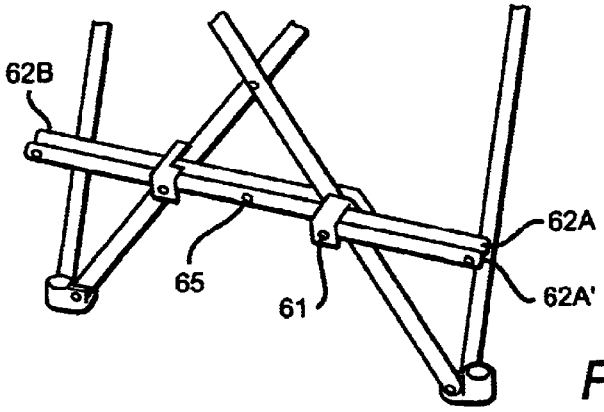
FIG. 16

APPARATUS TO SECURE A FURNITURE FRAMEWORK

This application is a continuation-in-part of U.S. patent application Ser. No. 09/585,250, which was filed May 30, 2000.

FIELD OF THE INVENTION

The present invention is directed to an apparatus for securing a framework that may be used in furniture applications such as a folding chair or a table. Specifically, preferred embodiments of the present invention provide a horizontal support that can be attached to a cross support frame structure used in furniture applications.

BACKGROUND OF THE INVENTION

FIG. 11 shows an example of a conventional folding chair 100 with conventional framework of crossing support 101. The folding chair 100 is collapsible by folding the chair from front to back as well as from side to side, thereby substantially compacting the size of the chair. The seat covering material 10 2 is typically made of cloth so that the seat may be collapsible along with the folding chair.

Due to the typical light-weight construction of the crossing support 101, the chair 100 typically cannot support any excessive load, or be constructed above a certain height, without losing support integrity (i.e., may collapse or wobble).

SUMMARY OF THE INVENTION

Preferred embodiments of the present invention provide an apparatus for securing a framework used in furniture applications such as a folding chair or a table. Specifically, preferred embodiments of the present invention provide a crossing frame support with a horizontal support element and a latching element.

Advantages of the present invention include providing additional integrity to a framework of crossing support and facilitating such a framework to be used in furniture applications with a greater height construction or in applications that may need to support a heavier load. In one aspect of the present invention, the horizontal support element can also be used as a foot rest for a chair.

BRIEF DESCRIPTION OF THE DRAWINGS

FIG. 1 is a front view of a preferred embodiment of the present invention.

FIG. 2 is a side view of the preferred embodiment of the present invention in FIG. 1.

FIG. 3 is a top view of the preferred embodiment of the present invention in FIG. 1.

FIG. 11 shows a horizontal support element according to another preferred embodiment of the present invention.

FIG. 12 shows the horizontal support element according to FIG. 11 when the support element is partially folded.

FIG. 13 is a perspective view of a conventional folding chair.

FIG. 14 is a photograph depicting a perspective view of yet another preferred embodiment of the inventive subject matter.

FIG. 15 is a photograph depicting a first detail view of the furniture of FIG. 14.

FIG. 16 is a photograph depicting a second detail view of the furniture of FIG. 14.

DETAILED DESCRIPTION

Preferred embodiments of the present invention will now be described in detail with references to FIGS. 1 to 10.

Figure 10:
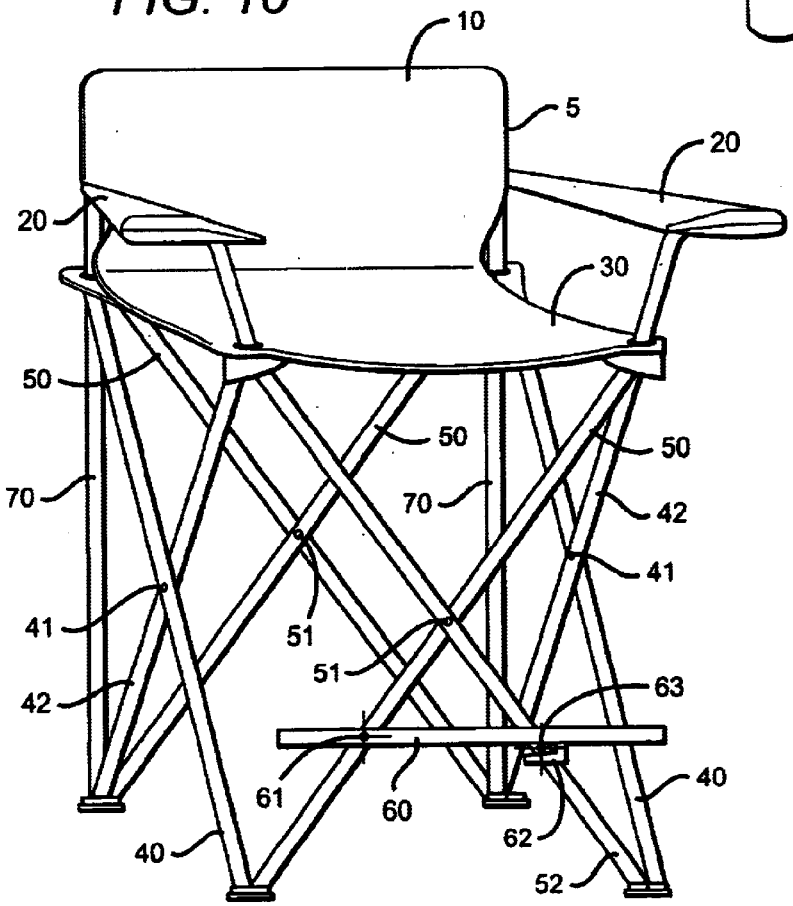
FIG. 10 is a perspective view of the preferred embodiment of FIG. 1.

FIG. 10 shows a perspective view of the preferred embodiment of the present invention, and FIGS. 1–3 illustrate front, side, and top views of a preferred embodiment of the present invention, respectively. FIGS. 1–3 show a chair that is supported by a framework having front and back crossing supports 50 and 52, and side crossing supports 40 and 42, each set of crossing supports are joint at pivotal points 51 and 41, respectively. The chair 5 is collapsible by folding the crossing support elements 40, 42, 50, and 52.

Figure 4:
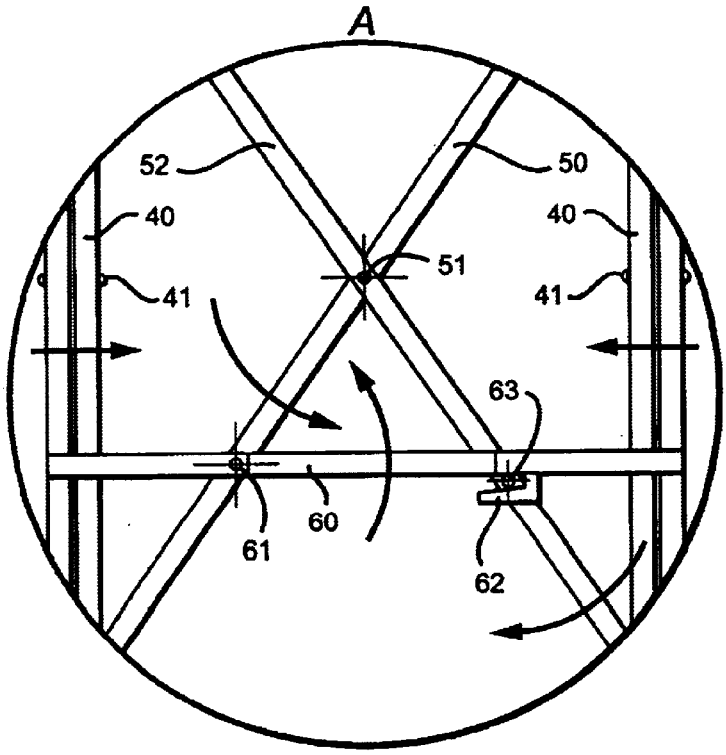
FIG. 4 is a detailed front view of the preferred embodiment of the present invention shown in FIG. 1.
Figure 6:
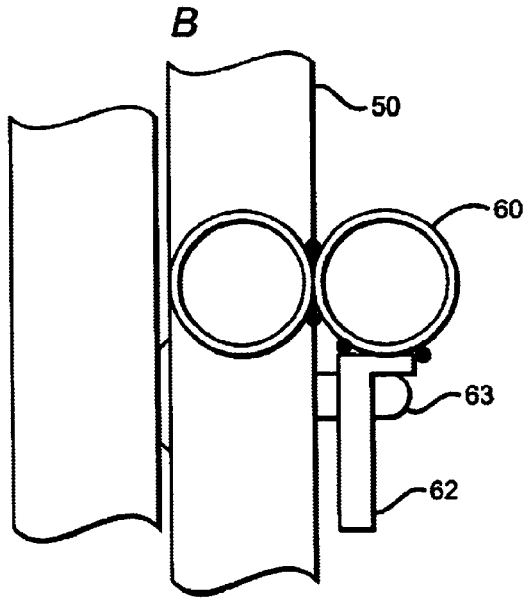
FIG. 6 is a detailed side view of the horizontal support and latching element according to one embodiment of the present invention.

FIG. 4 shows a horizontal support element 60 that is attached to the front crossing supports at a pivotal joint 61, which in this particular embodiment is shown as located on support element 50. The horizontal support element preferably includes a latching element 62 that can be removably secured onto a fixed joint 63, which in the preferred embodiment is shown as located on support element 52. FIG. 6 is a close-up side view of the horizontal support element 60 and latching element 62, which is shown as removably secured on the fixed joint 63.

Figure 5:
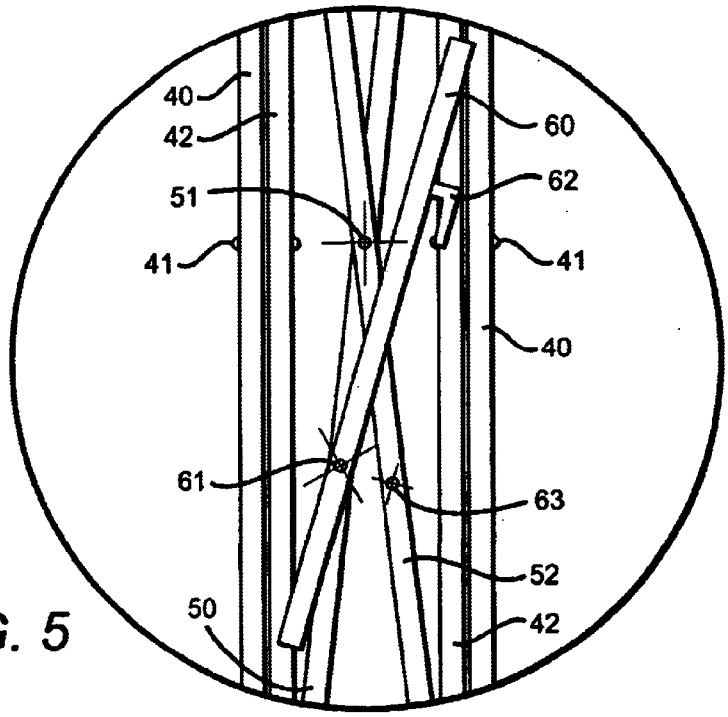
FIG. 5 is a second detailed front view of the preferred embodiment of the present invention shown in FIG. 1.

FIG. 5 shows the crossing supports 50 and 52 in a folded position. The latching element 62 is removed from the fixed joint 63, permitting the horizontal support element 60 to pivot along the pivotal joint 61. It is noted that although FIGS. 1–3 and 10 show the horizontal support element 60 as being attached to the front crossing support elements 50 and 52 of the chair 5, other preferred embodiments of the present invention may attach the horizontal support element on any of the other sets of crossing supports.

In other embodiments of the present invention, the horizontal support element may be secured to the crossing elements without using the pivotal joint 61 or including the latching element 62. For instance, the horizontal support may be secured onto the cross support framework using screws, Velcro, or other similar securing means. Alternatively, the horizontal support can simply be placed or secured on top of two protruding elements (e.g., pegs) attached to support elements 50 and 52.

Figure 9:
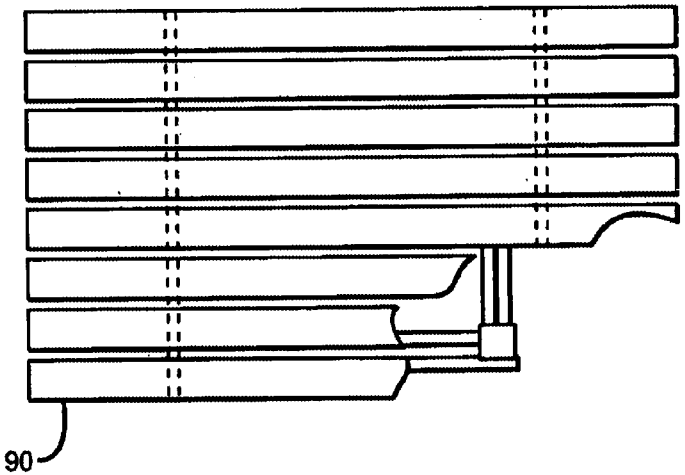
FIG. 9 is a top view of the embodiment of FIG. 7.
Figure 7:
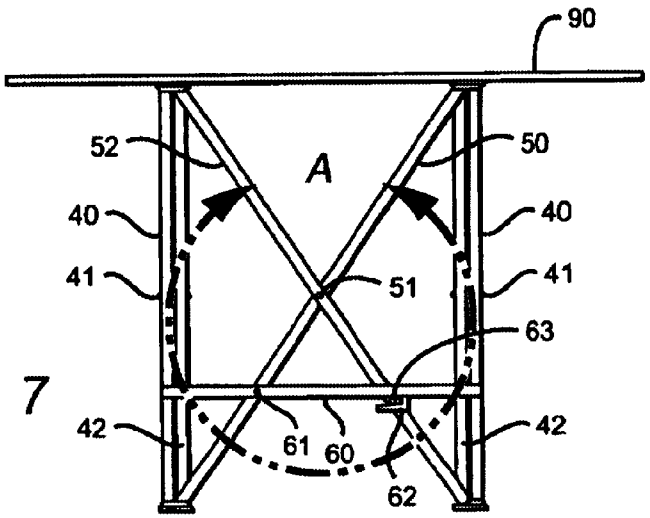
FIG. 7 is a front view of another embodiment of the present invention.
Figure 8:
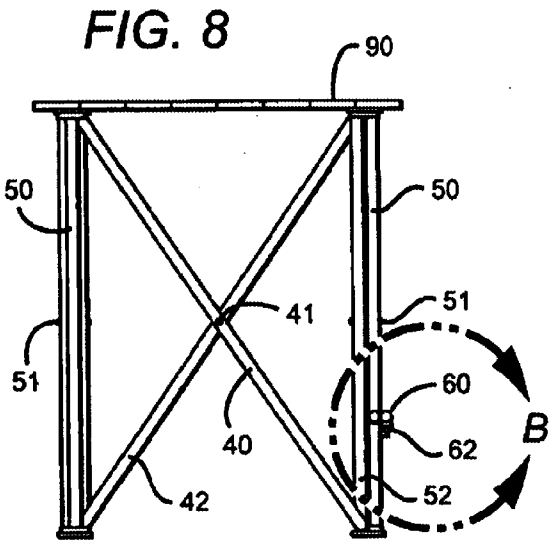
FIG. 8 is a side view of the embodiment of FIG. 7.

FIGS. 7–9 shows another embodiment of the present invention wherein the pivotal support is attached to a cross support framework in the furniture application of a table. In a like manner, other embodiments of the present invention may include using the pivotal support in crossing support framework of other furniture applications.

Referring to FIG. 11, there is shown another preferred embodiment of a horizontal support element 80. The horizontal support element 80 is made of two support elements 80*a* and 80*b* that are joined at a pivot point 85. At the pivot point 85, a latch 87 is provided to secure the support elements 80*a* and 80*b* in the horizontal position in order to stabilize the framework when heavy loads need to be supported. When the framework is folded as shown in FIG. 12, note that the support elements 80*a* and 80*b* cross each other.

In a further particularly preferred aspect of the inventive subject matter, the furniture is a collapsible barstool as exemplarily shown in FIG. 14. Here the collapsible barstool 1 has a first pair of elongated elements 40A, a second pair of elongated elements 40B, a third pair of elongated elements 40C, and a fourth pair of elongated elements 40D, all of which are coupled together in a quad configuration. A seat 30 is slidably coupled to the first, second, third, and fourth pair of elongated elements, thereby forming a collapsible chair. The seat is further continuously coupled to a back support 10, which is at least in part supported by the back support rod 70. Further coupled to the back support rod 70 and the elongated elements of at least one pair of elongated elements is armrest 20. A stabilizing bracket 60 (comprising first portion 62A and second portion 62B coupled together via pivot 65) is rotatably coupled via a coupling bracket 61 to one of the pairs of elongated elements, wherein the stabilizing bracket automatically moves from an open to a closed configuration as the collapsible chair is unfolded from a folded to an unfolded configuration.

The term "quad configuration" or "quad chair" are used interchangeably herein and refer to a chair (or other furniture) or a configuration having a plurality of elongated elements in which four pairs of two elongated elements are coupled to each other and form a three-dimensional structure with four sides, wherein the two elements of each pair are rotatably coupled to each other, and at least one element of one side is rotatably and/or slidably coupled to an element of another side. As also used herein, the term "collapsible chair" (or other furniture) means that the chair (or other furniture) folds front to back as well as from side to side, preferably in a single motion. Thus, preferred collapsible chairs will typically lack (at least) a pair of front legs that support the seating surface, while at least the front pair of elongated elements carry part of the weight of a person that sits on the chair. A typical example for a quad chair is described in U.S. Pat. No. 6,322,138 to Tang, which is incorporated by reference herein.

As still further used herein, the term "open configuration" when used in conjunction with the stabilizing bracket means that the stabilizing bracket is in a configuration that allows collapsing of the chair using reasonable force (i.e., force without permanently deforming one or more of the elongated elements of the chair). For example, where the stabilizing bracket comprises two portions coupled together via a pivot, the first and second portion may form an angle of at least 20 degrees relative to each other (away from a parallel orientation) in contemplated configurations. Thus, the term "closed configuration" when used in conjunction with the stabilizing bracket means that the stabilizing bracket is in a configuration that prevents collapsing of the chair using reasonable force (i.e., force without permanently deforming one or more of the elongated elements of the chair). For example, where the stabilizing bracket comprises two portions coupled together via a pivot, the first and second portion may form an angle of less than 20 degrees, and more typically less than 10 degrees relative to each other (away from a parallel orientation) in contemplated configurations. The term "automatically moves" as used herein means that no direct manipulation of the stabilizing bracket is needed to move the bracket. For example, where the force to move the bracket is provided by an element other than the stabilizing bracket (e.g., via elongated elements), the movement is not direct. The term "direct manipulation" means that a user touches the stabilizing bracket and exerts force to the stabilizing bracket.

It should be recognized that suitable chairs may preferably include a back support rod that is coupled to at least one of the first, second, third, and fourth pair of elongated elements, and that a back support (e.g., continuous with the seat) may be coupled to the back support rod. Where desired, contemplated chairs may further comprise an armrest, which is preferably coupled to one elongated element of at the least one of the first, second, third, and fourth pair of elongated elements.

With respect to the stabilizing bracket, it is generally preferred that the stabilizing bracket comprises a first portion and a second portion that are coupled together by a pivot, and that at least one of the first and second portions are rotatably coupled to the at least one of the first, second, third, and fourth pair of elongated elements via a coupling bracket. An exemplary preferred stabilizing bracket is depicted in FIGS. 15 and 16 in which the stabilizing bracket has a first portion 62A and an additional first portion 62A'. The first portion is rotatably coupled to one of the elongated elements of one of the pairs of elongated elements via a coupling bracket 62, and a pivot 65 rotatably couples the first portion 62A to the second portion 62B. It should be particularly appreciated that the pivot 65 is located on at least one of the first and second portions in a position away from the end of the first and/or second portions. Consequently, when the stabilizing bracket moves from an open to a closed configuration, at least one of the first and second portions may engage with the coupling bracket of the opposite portion. Thus, it is contemplated that the coupling bracket of the first portion may receives at least part of the second portion when the chair is in the unfolded configuration. Alternatively, however, the first and second element may be coupled together via a pin that rotatably couples the respective ends of the first and second portions. In such cases, it is contemplated that an additional locking mechanism (e.g., sliding sleeve or a half-sleeve) may be provided to prevent inadvertent folding of the chair.

In further preferred aspects, the coupling bracket of the first portion may further include an element that locks the at least part of the second portion to the coupling bracket when the coupling bracket is in the closed configuration, and especially contemplated locking elements include hook-and-loop type fasteners, one or more elastic protrusions that help retain the engaged portion ("holding teeth"), snaps, and even manually operable locks. Where the coupling bracket is provided as an "upgrade" to an existing quad chair, it should be appreciated that the coupling bracket may be removably coupled to the at least one of the first, second, third, and fourth pair of elongated elements, and all manners of removable coupling are considered suitable for use herein. For example, removable coupling may be achieved by bolting, screwing, latching, etc.

It should generally be appreciated that the coupling bracket greatly enhances mechanical stability of a quad chair, and especially of a quad chair that supports significant weight and/or a in which the seat has a width W at a height H (when the chair is in an unfolded configuration), and wherein H is at least 1.5 times W, and more preferably H is at least 2.2 times W. While quad chairs without contemplated stabilizing brackets are known to wobble, or even twist and eventually collapse, contemplated chairs including a stabilizing bracket exhibit superior stability, even if the seat is relatively high positioned. Thus, particularly preferred configurations include collapsible barstools in which the seat is at least 50 cm, more typically at least 65 cm, and most typically at least 80 cm away from the ground when the chair is in an unfolded configuration and position to support a person.

In yet further aspects of the inventive subject matter, it is generally contemplated that all materials known to furniture manufacture are deemed suitable for use herein. However, especially preferred materials for the elongated elements and stabilizing brackets are light-weight metals, and particularly aluminum. With respect to the seat and back support, it is generally preferred that the material comprises a polymer, and most preferably a polyethylene, polypropylene, polyacetate, and/or polyvinyl chloride. Elongated elements typically include rods, cylinders, or otherwise hollow structures in which the longest dimension is typically at least 5, more typically at least 10 times, and most more typically at least 20 times the greater of the remaining two dimensions.

Moreover, there are numerous manners of rotatably and/or slidably coupling components in a collapsible chair known in the art, and all of the known methods are contemplated suitable for use herein. However, particularly preferred methods of rotatably coupling include hinges, flexible elements, pins, pivots, etc., while, particularly preferred methods of slidably coupling include guide rails, sliding guide elements (e.g., sliding sleeve), etc.

Consequently, particularly preferred collapsible chairs will include a first pair of elongated elements, a second pair of elongated elements, a third pair of elongated elements, and a fourth pair of elongated elements, all of which are coupled together in a quad configuration; a seat slidably coupled to at least one of the first, second, third, and the fourth pair of elongated elements, thereby forming a collapsible chair; and a stabilizing bracket rotatably coupled to at least one of the first, second, third, and fourth pair of elongated elements, wherein the stabilizing bracket automatically moves from an open to a closed configuration as the collapsible chair is unfolded from a folded to an unfolded configuration Thus, specific embodiments and applications of an apparatus to secure a furniture framework have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a first pair of elongated elements, a second pair of elongated elements, a third pair of elongated elements, and a fourth pair of elongated elements, all of which are coupled together in a quad configuration;

a seat slidably coupled to at least one of the first, second, third, and the fourth pair of elongated elements, thereby forming a collapsible chair; and a stabilizing bracket comprising a first portion and a second portion coupled together by a pivot;

wherein at least one of the first and second portions are rotatably coupled to the at least one of the first, second, third, and fourth pair of elongated elements via a coupling bracket and wherein one of the first and second portions extend beyond the coupling bracket; and wherein the stabilizing bracket is rotatably coupled to at least one of the first, second, third, and fourth pair of elongated elements, wherein the stabilizing bracket automatically moves from an open to a closed configuration as the collapsible chair is unfolded from a folded to an unfolded configuration.

2. The collapsible chair of claim 1 wherein the coupling bracket of the first portion receives at least part of the second portion when the chair is in the unfolded configuration.

3. The collapsible chair of claim 2 wherein the coupling bracket of the first portion further comprises an element that locks the at least part of the second portion to the coupling bracket when the coupling bracket is in the closed configuration.

4. The collapsible chair of claim 1 wherein the seat has a width W and is at a height H when the chair is in an unfolded configuration, and wherein H is at least 1.5 times W.

5. The collapsible chair of claim 1 wherein the seat has a width and is at a height H when the chair is in an unfolded configuration, and wherein H is at least 2.2 times W.

6. The collapsible chair of claim 1 further comprising a back support rod coupled to at least one of the first, second, third, and fourth pair of elongated elements, and further coupled to a back support.

7. The collapsible chair of claim 1 wherein the back support is continuous with the seat.

8. The collapsible chair of claim 1 further comprising an armrest.

9. The collapsible chair of claim 8 wherein the armrest is coupled to one elongated element of at the least one of the first, second, third, and fourth pair of elongated elements.

* * * * *